US006880728B1

(12) United States Patent
Moisio et al.

(10) Patent No.: US 6,880,728 B1
(45) Date of Patent: Apr. 19, 2005

(54) CLOSURE CAP

(75) Inventors: Franck Moisio, Arlesheim (CH); Caspar Stürm, Muttenz (CH)

(73) Assignee: Pentapharm AG, Basel (CH)

( * ) Notice: Subject to any disclaimer, the term of this patent is extended or adjusted under 35 U.S.C. 154(b) by 0 days.

(21) Appl. No.: 10/312,821

(22) PCT Filed: Jul. 5, 2000

(86) PCT No.: PCT/EP00/06281

§ 371 (c)(1),
(2), (4) Date: Feb. 12, 2003

(87) PCT Pub. No.: WO02/02427

PCT Pub. Date: Jan. 10, 2002

(51) Int. Cl.[7] ..... B67B 5/00; B67D 5/06
(52) U.S. Cl. ..... 222/153.07; 222/531
(58) Field of Search ..... 222/153.05–153.08, 222/531, 532

(56) References Cited

U.S. PATENT DOCUMENTS 3,651,992 A * 3/1972 Hazard ..... 222/153.06
4,081,108 A 3/1978 Wilson et al.
5,356,044 A * 10/1994 LaVange ..... 222/153.06
5,542,585 A * 8/1996 Peters et al. ..... 222/531
5,615,809 A 4/1997 Feer et al.

FOREIGN PATENT DOCUMENTS

FR 2 251 493 6/1975

* cited by examiner

*Primary Examiner*—Michael Mar
*Assistant Examiner*—Patrick Buechner
(74) *Attorney, Agent, or Firm*—Jones Day

(57) ABSTRACT

Closure cap (1) for closing a liquid container (4) such as a vial, flask etc., having takeout means (14) for withdrawing liquid from the container without removing the cap and thereafter re-closing it, and protecting means (22) for proving the authenticity of the content of the container characterized by a skirt portion (2) and a cover (3), a recessed trough (6) in the cover, a fodable spout (14) having a spherical bearing portion (15) seated in a cylindrical portion (7) of the trough, and a channel (17) extending lengthwise through the spout.

3 Claims, 2 Drawing Sheets

CLOSURE CAP

This invention relates to a closure cap for closing a liquid container such as a vial, flask etc., having takeout means for withdrawing liquid from the container without removing the cap and thereafter re-closing it, and protecting means for proving the authenticity of the content of the container.

Bottle closing caps with takeout means for withdrawing a small amount of the liquid contained in the bottle and thereafter re-closing it are well-known in everyday life, e.g. for liquid soap, shampoo, spices etc. Most of these closing caps do not have to be tamper-proof. If they have to, usually a separate seal is provided which is broken at the occasion of the first opening.

For pharmaceutical or other uses where authenticity of the container content is absolutely critical and in addition the sterility of the content has to be guaranteed during the whole length of time until the container is emptied, there is no satisfactory solution available by now. This is especially true when at the same time for economical reasons the closure cap should be easy to produce and to apply to the container.

The purpose of the present invention is to provide such a closure cap which fulfils all these requirements.

Figure 1:
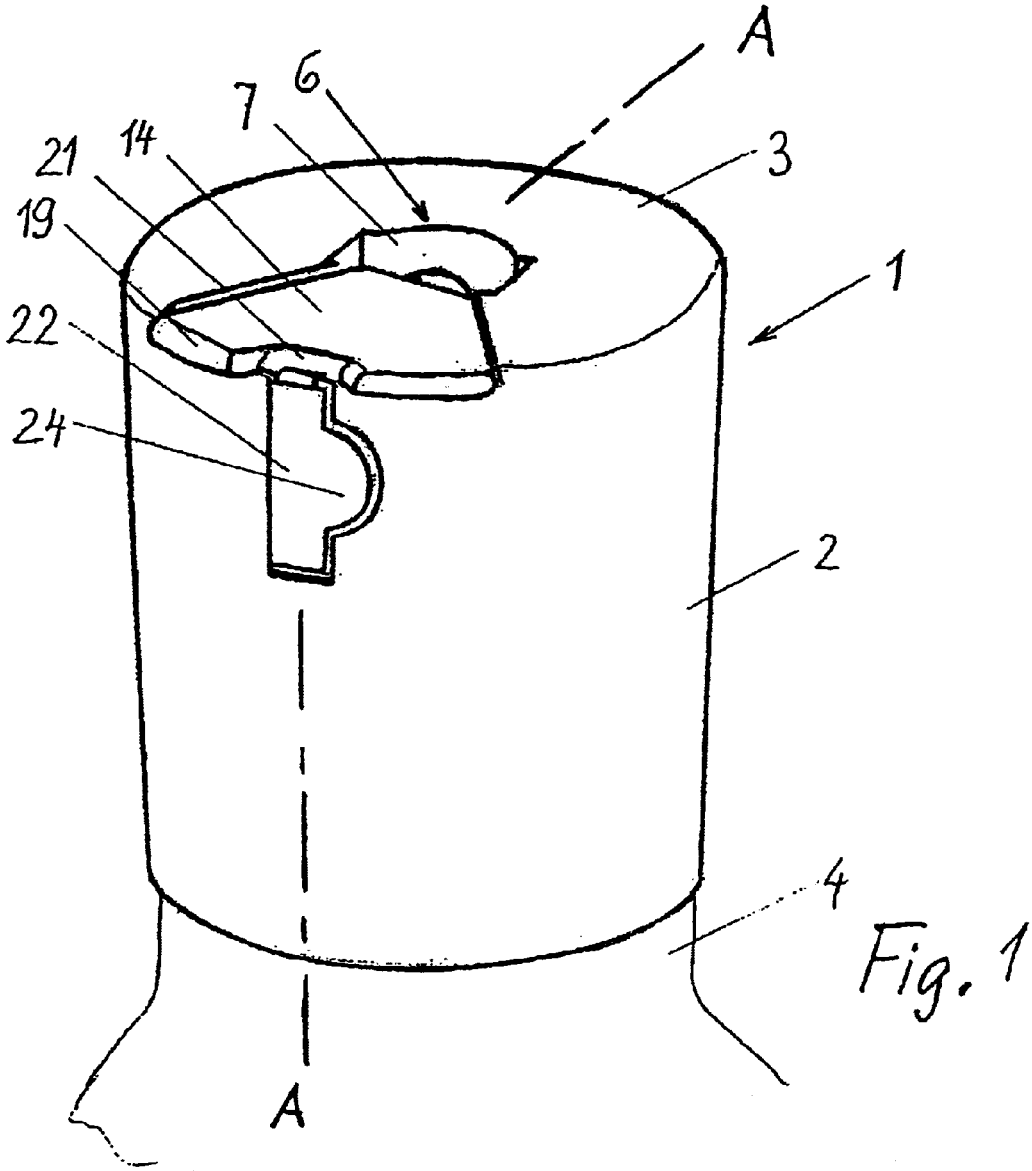
Figure 2:
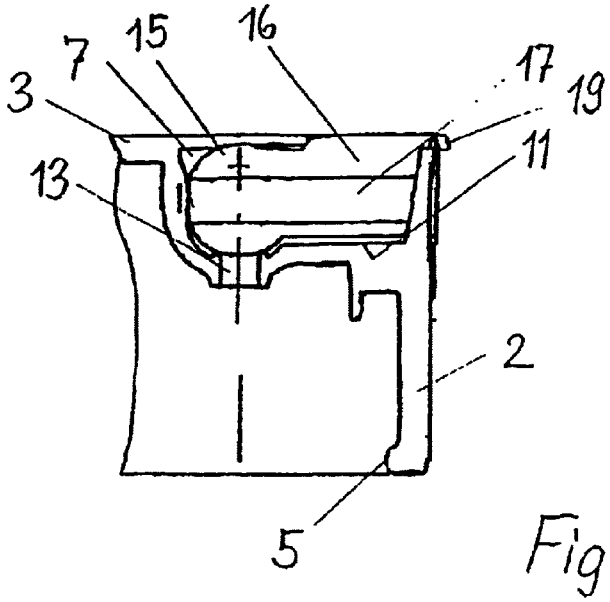

According to the invention this is achieved by a closure cap having the features defined in the claims. In the following a preferred embodiment of the invention is described with reference to the accompanying drawings. It is shown in FIG. 1 a perspective view of a closure cap according to an embodiment of the invention FIG. 2 a cross section along line A—A in FIG. 1

Figure 3:
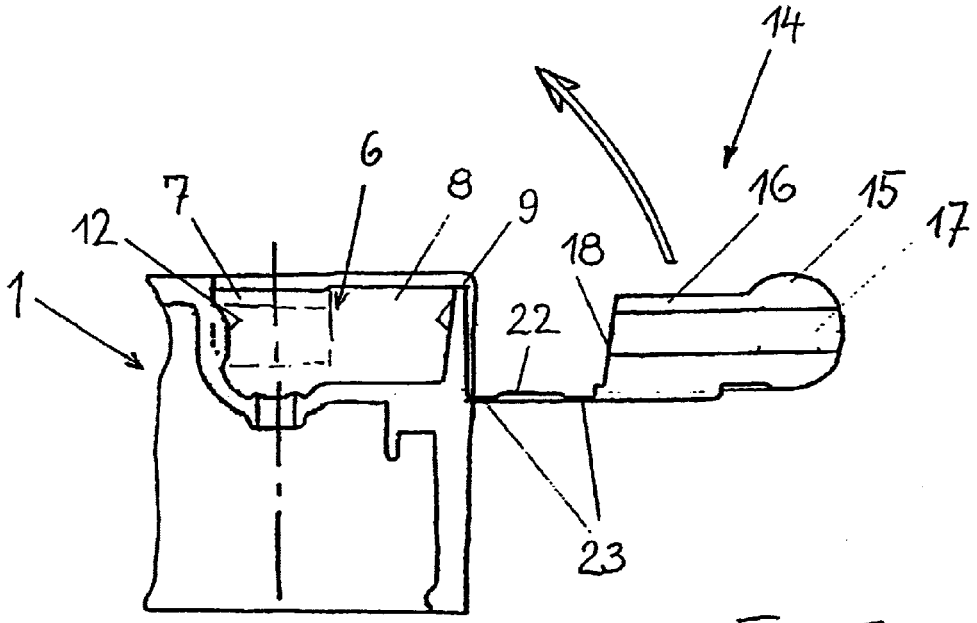

FIG. 3 another cross section along the same plane but unfolded

The closure cap shown in the figures consists of a main part 1 having a cylindrical or slightly conical skirt 2 and an essentially flat circular cover 3. In use the skirt 2 tightly fits over the neck of a container 4. For this purpose the inner surface of the skirt 2 is provided with an inwardly directed annular projection 5 with which the cap is snap-fitted over a corresponding outwardly directed annular rim (not shown) around the container neck. This is well-known in the art.

The cover is essentially flat but has a recessed trough 6 in its upper surface. The trough 6 has side walls 7–9 and a bottom 11. An essentially cylindrical side wall portion 7 is surrounding the central axis of the cap for the greater part of a full circle, i.e. about 330°. To one side, i.e. the direction of the remainder of the full circle the trough 6 extends to the skirt 2 of the closure cap. To this end the trough 6 has radially extending side wall portions 8. At the skirt 2 the trough 6 has a sloping side wall portion 9. As a consequence of this configuration of the side walls the bottom 11 is approximately keyhole-shaped with angularly widening flanks when looked from above.

The cylindrical side wall portion 7 is provided with an annular bulge 12 projecting towards the axis or centre of the closure cap. An opening 13 is arranged coaxially in the centre of the circular portion of the bottom 11.

The trough 6 is the seat of a foldable spout 14. Foldable spout 14 consists of a spherical bearing portion 15 and an elongated beak portion 16. A channel 17 extends throughout the bearing portion 15 and the beak portion 16 and is open at both ends.

The spherical bearing portion 15 is dimensioned such that its diameter is slightly larger than the narrowest diameter of the bulge 12. The axial position of the bulge is such that the distance between its narrowest diameter and the level of the lowest point of the circular portion of the trough

6 is slightly greater than the diameter of the spherical bearing portion 15. As a consequence of this dimensional configuration the spherical bearing portion 15 when pressed into the cylindrical portion of the trough 6 snaps into the position shown in FIG. 2 in which it is appropriately hold in place. At the same time the lower surface of the spherical bearing portion 15 closes the opening 13.

In the snapped-in position the seat of the spherical bearing portion 15 allows rotation of the spout to bring the beak portion 16 in an upright position in which the channel is aligned with the opening. Thus, in this position liquid can flow out from the interior of the container through opening and channel.

The beak portion 16 has an oblique front 18 which abuts on the sloped wall portion 9. Above the upper edge of the sloped wall portion 9 the beak portion 16 has two lids 19 extending on both sides of a niche 21 beyond the outer surface of the skirt 2.

The niche 21 of the spout portion is connected to the skirt 2 by means of a thin, band-shaped plate 22 which has reduced thickness areas 23 at its connection to the skirt 2 and the spout. The reduced thickness areas 23 constitute defined breaking zones. At the side of its centre portion the plate 22 has an essentially semi-circular flat extension 24 serving as a grip for tearing off the plate at the occasion of the first withdrawal of liquid from the container. Accordingly, the plate constitutes the tamper-proof seal.

All parts of the closure cap, i.e. the skirt 2, the cover, the spout and the plate 22 are moulded as one piece in the position shown in FIG. 3. After the closure cap is removed from the mould the spout is folded into the trough 6 as indicated by the arrow in FIG. 3. When it is entirely folded about the two hinges 23 the spherical bearing portion 15 is snapped into its seat and the closure cap is ready to be put on a container.

When the user intends to take out the first amount of liquid he first removes the plate 22 either with his finger nail or with a tool. He then rotates the spout into the upright position by lifting the two lids of the beak portion 16. After having taken out the desired amount of liquid, the spout is rotated back into the trough 6 thereby closing the opening and at the same time hiding the channel behind the sloped side wall portion to protect it from contamination.

What is claimed is:

1. A closure cap for closing a liquid container comprising:

a foldable spout for withdrawing liquid from the container without removing the cap and thereafter re-closing it, and a tamperproof seal for ensuring the authenticity of the content of the container, the cap comprising a skirt portion, a cover, and a recessed trough formed in the cover, the spout comprising a spherical bearing portion and an elongated beak sized and configured to seat within a cylindrical portion of the trough, and a channel extending lengthwise through the spout, wherein the tamperproof seal comprises a band-shaped plate integrally connected to the skirt portion and to the end of the beak remote from the bearing portion.

2. The closure cap of claim 1, wherein the cylindrical portion of the trough has a bulge projecting towards the center of the closure cap.

3. The closure cap of claim 1, wherein the trough has a sloping side wall portion adjacent the skirt and the remote end of the beak has an oblique front portion to abut on the sloped side wall portion of the trough.

* * * * *